US012643199B2

(12) United States Patent
Gabris et al.

(10) Patent No.: US 12,643,199 B2
(45) Date of Patent: Jun. 2, 2026

(54) DEVICE FOR REDUCING THE SIZE OF DRY ICE GRANULES FOR DRY ICE CLEANING DEVICES

(71) Applicant: ICS ICE CLEANING SYSTEMS S.R.O., Povazská Bystrica (SK)

(72) Inventors: Peter Gabris, Povazská Bystrica (SK); Ivan Kubis, Povazská Bystrica (SK); L'udovit Bakala, Povazská Bystrica (SK)

(73) Assignee: ICS ICE CLEANING SYSTEMS S.R.O. (SK)

( * ) Notice: Subject to any disclaimer, the term of this patent is extended or adjusted under 35 U.S.C. 154(b) by 1282 days.

(21) Appl. No.: 17/599,604

(22) PCT Filed: Mar. 30, 2020

(86) PCT No.: PCT/SK2020/050005
§ 371 (c)(1),
(2) Date: Sep. 29, 2021

(87) PCT Pub. No.: WO2020/204841
PCT Pub. Date: Oct. 8, 2020

(65) Prior Publication Data

US 2022/0193864 A1 Jun. 23, 2022

(30) Foreign Application Priority Data

Mar. 31, 2019 (SK) ..... 50017-2019

(51) Int. Cl.
*B24C 7/00* (2006.01)
*B24C 1/00* (2006.01)
*F25C 5/12* (2006.01)

(52) U.S. Cl.
CPC ..... *B24C 7/0092* (2013.01); *B24C 1/003* (2013.01); *F25C 5/12* (2013.01)

(58) Field of Classification Search
CPC ..... B24C 7/0092; B24C 1/003; F25C 5/12
See application file for complete search history.

(56) References Cited

U.S. PATENT DOCUMENTS 4,974,592 A 12/1990 Branco ..... 128/635
6,346,035 B1 2/2002 Anderson et al. ..... 451/99
(Continued)

FOREIGN PATENT DOCUMENTS

CN 2801303 Y 8/2006
EP 1 637 282 A1 3/2006
(Continued)

OTHER PUBLICATIONS

International Search Report mailed Jul. 16, 2020 in corresponding PCT International Application No. PCT/SK2020/050005.
(Continued)

*Primary Examiner* — Moshe Wilensky
(74) *Attorney, Agent, or Firm* — OSTROLENK FABER LLP

(57) ABSTRACT

A device for reducing the size of dry ice granules for dry ice cleaning devices including a supply of dry ice to a device for mixing of dry ice particles with the flow of gaseous medium. The device includes a die with a set of orifices for granulate passing and a granulate pushing-through member for pushing the granulate into the die. The die is placed in a body with at least one sloped surface inclining to the inside of the body towards the die, which, the body, is connectable to a supply of dry ice granulate to a device for mixing of dry ice particles with the flow of gaseous medium in a dry ice cleaning device, where above the die a granulate pushing-through member is movably mounted. The pushing-through member includes at least one surface facing the die, where this surface forms an acute angle with the die surface, and the orifices of the die at the side of the pushing-through member are provided with a recess or shape modification of
(Continued)

the edge of the orifice increasing the roughness of the surface of the die relative to the roughness of the surface of the pushing-through member.

11 Claims, 6 Drawing Sheets

(56) References Cited

U.S. PATENT DOCUMENTS

| | | | | |
|---|---|---|---|---|
| 2006/0207270 | A1 | 9/2006 | Voglewede et al. | 62/135 |
| 2013/0139853 | A1* | 6/2013 | Solenthaler | B24C 1/003 222/189.02 |

FOREIGN PATENT DOCUMENTS

| | | | |
|---|---|---|---|
| EP | 2 151 301 | A1 | 2/2010 |
| EP | 2 420 353 | A1 | 2/2012 |
| EP | 2 832 500 | A1 | 2/2015 |
| JP | H07-61805 | A | 3/1995 |
| NL | 1015216 | C2 | 11/2001 |
| WO | WO 86/00833 | A1 | 2/1986 |
| WO | WO 2014/182253 | A1 | 11/2014 |
| WO | WO 2017/039548 | A1 | 3/2017 |

OTHER PUBLICATIONS

Written Opinion mailed Jul. 16, 2020 in corresponding PCT International Application No. PCT/SK2020/050005.

* cited by examiner

DEVICE FOR REDUCING THE SIZE OF DRY ICE GRANULES FOR DRY ICE CLEANING DEVICES

CROSS-REFERENCE TO RELATED APPLICATIONS

The present application is a 35 U.S.C. §§ 371 national phase conversion of PCT/SK2020/050005, filed Mar. 30, 2020, which claims priority Slovak Patent Application No. PP 50017-2019, filed Mar. 31, 2019, the contents of which are incorporated herein by reference. The PCT International Application was published in the English language.

TECHNICAL FIELD

The invention relates to the field of dry ice cleaning devices. In particular, this invention relates to devices for reducing the size of dry ice granules for dry ice cleaning devices.

BACKGROUND ART

Currently used dry ice cleaning devices have a construction as described e.g. in NL 1015216 C2, WO 8600833, U.S. Pat. No. 6,346,035, EP 1 637 282 A1, U.S. Pat. No. 4,974,592, CN 2801303, or WO 2014/182253. Dry ice cleaning devices works with dry ice granulate. The granulate, i.e. the dry ice pellets, are produced in separate devices designed for this purpose, the principle of which is based on the formation and extrusion of dry ice through a die with a size of the orifices according to the required size of the granulate.

The standard size of dry ice granules is approximately of 3 to 3.5 mm. This granulate is the most widely used and supplied by dry ice granulate manufacturers and is used in one-hose or two-hose systems that operate at sufficiently high pressure and air flow to ensure the efficiency of dry ice cleaning, i.e. sufficient kinetic energy of particles of dry ice accelerated from the nozzle of the device. Mentioned devices can be characterized as industrial, what is reflected in their purchase price and operation costs. For uses lesser than industrial, e.g. individual, so-called hobby use, small businesses such as car repair shops, small cleaning services, and so, the industrial devices are expensive and uneconomical, and thus such cleaning method in other than industrial range is not very widespread.

For lesser than industrial use, dry ice cleaning devices are produced, which however operate at lower outputs, or flow rates, usually using use two-hose systems. If the 3 to 3.5 mm granulate is used in these devices, the output provided is not sufficient to create kinetic energy for the cleaning to be efficient. Then, a granulate with a smaller size, less than 1.5 mm, is used for these applications. Producers of the granulate are also able to supply the smaller size granulate, however due to the smaller volumes bought from the producers, such granulate is much more expensive than standard size granulate supplied, thus making the operation of devices with lower outputs much costly.

The object of this invention is to provide a device for reducing the size of dry ice granules for devices for mixing of dry ice particles with the flow of gaseous medium, which would allow especially the devices with lower outputs, to use standardly produced dry ice granulate with size of 3 to 3.5 mm, without a need of separate preparation of smaller size granulate, while the size adjustment, the reduction of the size of granulate would take place directly in a dry ice cleaning device during its operation.

SUMMARY OF INVENTION

This object is achieved by a device for reducing the size of dry ice granules for dry ice cleaning devices comprising a supply of dry ice to a device for mixing of dry ice particles with the flow of gaseous medium, where the device for reducing the size of dry ice granules comprises a die with a set of orifices for granulate passing and a granulate pushing-through member for pushing the granulate into this die. The device is characterized in that the die is placed in a body with at least one sloped surface inclining to the inside of the body towards the die, which, the body, is connectable to a supply of dry ice granulate to a device for mixing of dry ice particles with the flow of gaseous medium in a dry ice cleaning device. The granulate pushing-through member is movably mounted above the die, where the pushing-through member comprises at least one surface forming an acute angle with the die surface. The die orifices at the side of the pushing-through member are provided with a recess or shape modification of the edge of the orifice increasing the roughness of the die surface relative to the roughness of the surface of the pushing-through member. The pushing-through member is located above the surface of the die at a distance smaller than the dimensions of the supplied granulate, and the largest transversal dimension of the die orifices is smaller than the largest dimension of the supplied granulate. Below the die is an outlet opening for the reduced granulate to a device for mixing of dry ice particles with the flow of gaseous medium.

Preferably, the die orifice is widening from the recess or the shape modification of the edge of the orifice.

Preferably, the pushing-trough member is linear reciprocating tool having its working part provided with at least one surface facing the die and forming an acute angle with the die surface.

Preferably, the working part of the tool is at its end provided by a sloped surface. This sloped surface prevents jamming of the granulate in front of the tool.

Preferably, a collector of the reduced granulate is connected to the outlet opening, provided with a collecting chamber for collecting the reduced granulate. The collecting chamber serves for drawing out the granulate in two-hose dry ice cleaning devices.

Preferably, the pushing-through member is a rotary blade wheel rotatively mounted in the body base plate, where a blade of the blade wheel comprises a surface facing the die and forming an acute angle with the die surface.

Preferably, the blade wheel has its body provided with a guide member of the supplied granulate.

Preferably, the die is arranged on a turntable housed in the base plate of the body, where the turntable further comprises a die inactivator in the form of an aperture lying on the same circle as the die, and/or at least one other die with a different size of orifices.

Preferably, a static pin is arranged in the body, which protrudes from the body into the space above the blades, where the distance of the pin from the highest point of the blade is less than blade spacing on the blade wheel.

Preferably, the supply of dry ice granulate to a device for mixing of dry ice particles with the flow of gaseous medium in the dry ice cleaning device is a dry ice container for dry ice cleaning devices and the body of the device according to this invention forms the bottom of the dry ice container.

BRIEF DESCRIPTION OF DRAWINGS

The invention is explained in more detail in the description of examples of embodiments with reference to the accompanying drawings, in which.

DESCRIPTION OF EMBODIMENTS

A device for reducing the size of dry ice granules for dry ice cleaning devices according to this invention will be further explained in more detail by two particular examples of embodiments shown in the figures. The figures show the device according to the invention and its parts. The drawings do not show the entire dry ice cleaning device, which typically comprises a supply of dry ice granulate, which is normally realized by a dry ice container, a device for mixing of dry ice particles with the flow of gaseous medium connectable to a source of compressed air, and a hose system for supplying the mixture of air and dry ice particles into a working nozzle, from which, during the operation, the mixture of air and dry ice is blasted at the object to be cleaned. These devices and their construction are known and it is not necessary to describe or illustrate them in more detail, because the position of this device in a dry ice cleaning device is obvious from the description of the device according to the invention.

One of the two examples of embodiments of the device according to the invention described below represents the device with linear, reciprocating, motion of the granulate pushing-through member 3 and the other represents the device with rotational motion of the pushing-through member 3.

Figure 1:
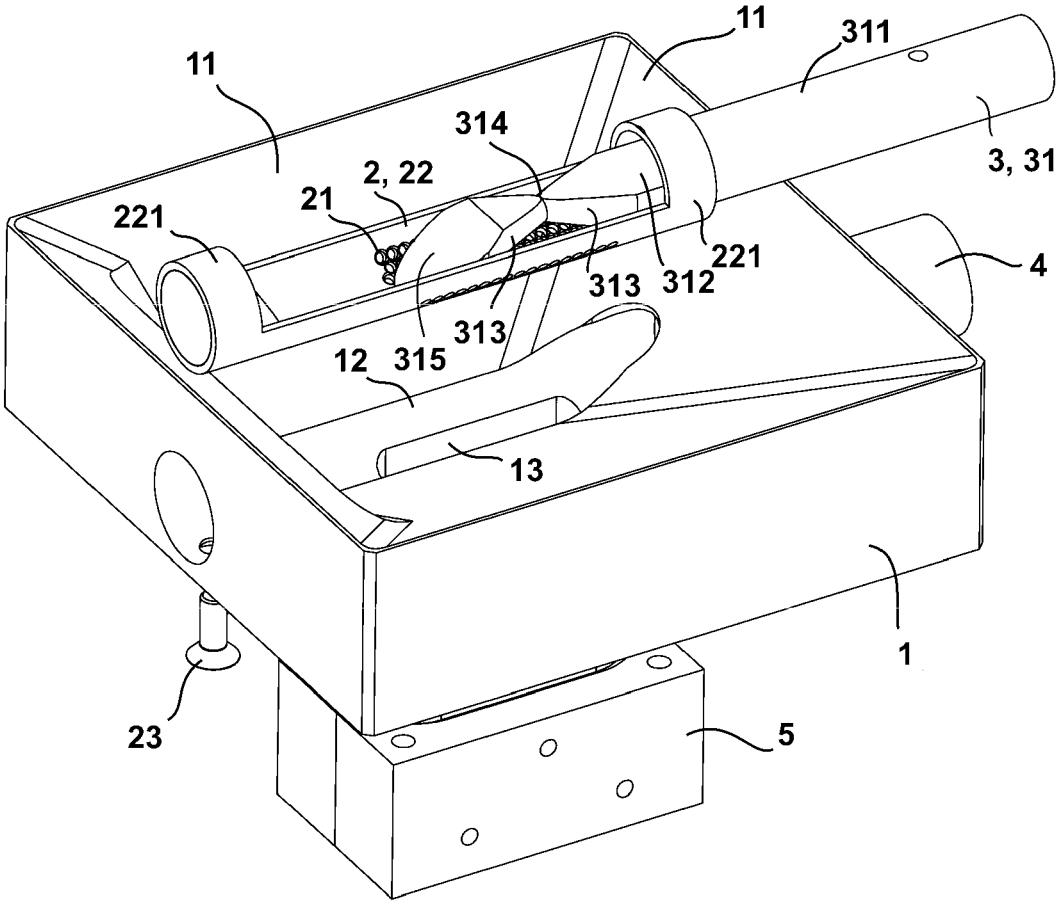
FIG. 1 shows an exploded view in perspective of the device according to the invention and its parts with the linear reciprocating pushing-through member of the granulate.
Figure 2:
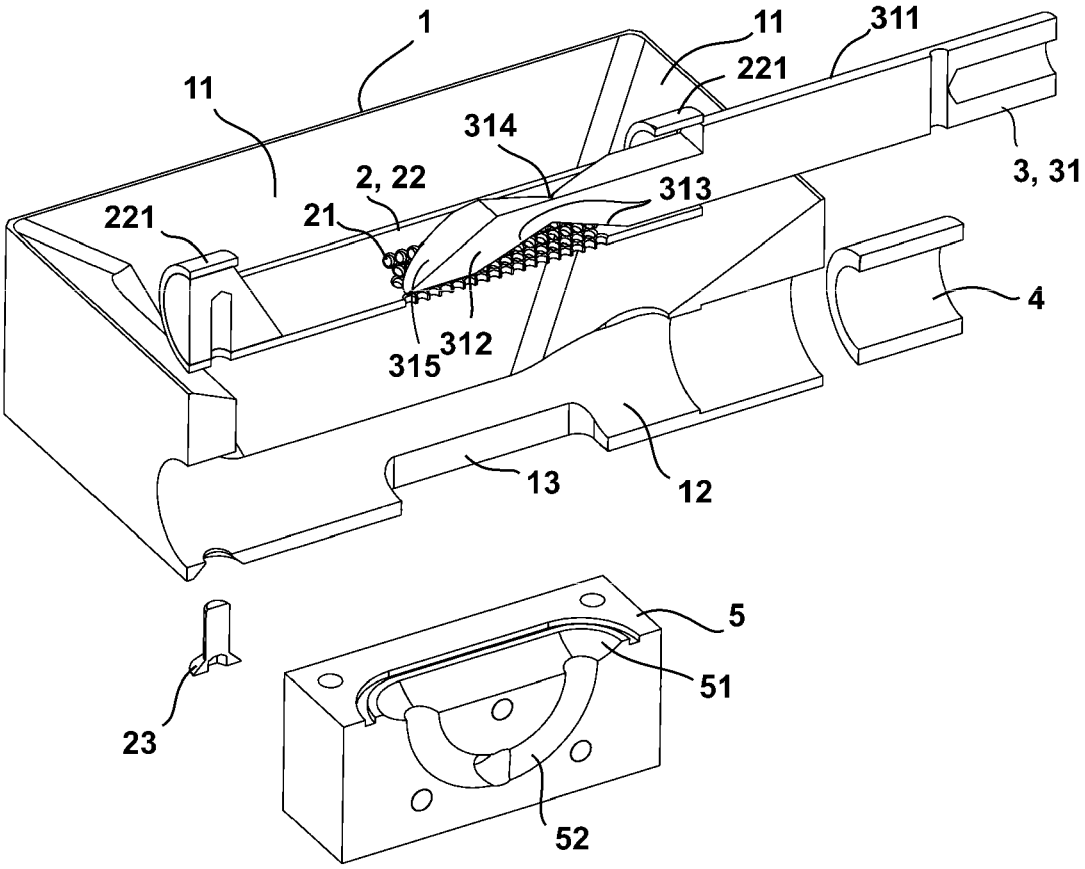
FIG. 2 shows a sectional exploded view in perspective of the device and its parts of FIG. 1.
Figure 3:
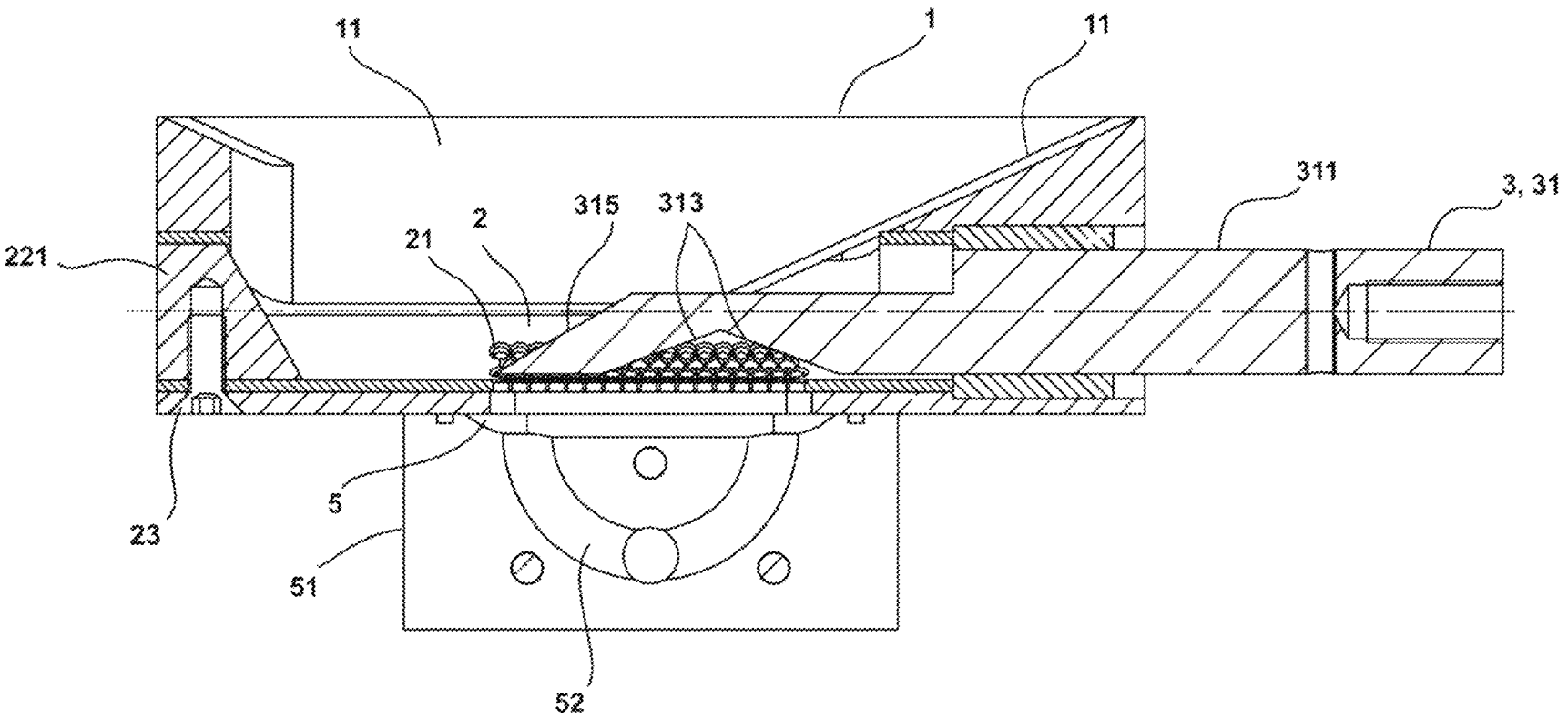
FIG. 3 shows a sectional side view of the device according to the invention with the linear reciprocating pushing-through member of the granulate.

The device according to this invention according to one example of embodiment, with linear motion of the pushing-through member 3, is shown in FIGS. 1, 2 and 3. The device comprises a body 1 with sloped surfaces 11 inclining to the inside of the body 1. In general, the body 1 is designed to be connectable to the supply of dry ice granulate in a dry ice cleaning device. In this example of embodiment, the body 1 is connectable to a dry ice container, where it will form the bottom of the dry ice container. This body 1 can also be formed as an integral part of a dry ice container. Thus, in this example, the supply of granulate will be provided by a conventional dry ice container, from which the granulate is gravitationally fed to a device for mixing of dry ice particles with the flow of air.

In the body 1, below the sloped surfaces 11, a die 2 with a set of orifices 21 is placed. The die 2 is formed in this example as a part of a cylindrical surface. In particular, the die 2 is formed by a hollow cylindrical body 22, which is open towards the sloped surfaces 11, thereby forming the die 2 in the shape of a part of a cylindrical surface. The ends 221 of this cylindrical body 22 are left in the full shape of a hollow cylinder and form means for placement of the die 2 in a cavity 12 of the body 1. At one end 221 the body 22 is open for passing of the pushing-through member 3, and at the other end 221 the body 22 is closed to avoid pushing the granulate out of the die 2 by the pushing-through member 3. The closed end 221 is then preferably provided by means for securing the die 2 against the body 1, for example in the form of a locking screw 23 passing through the body 1 into the closed end 221 of the cylindrical body 22. The body 1 is under the orifices 21 of the die 2 provided by an outlet opening 13 for reduced granulate.

Figure 6:
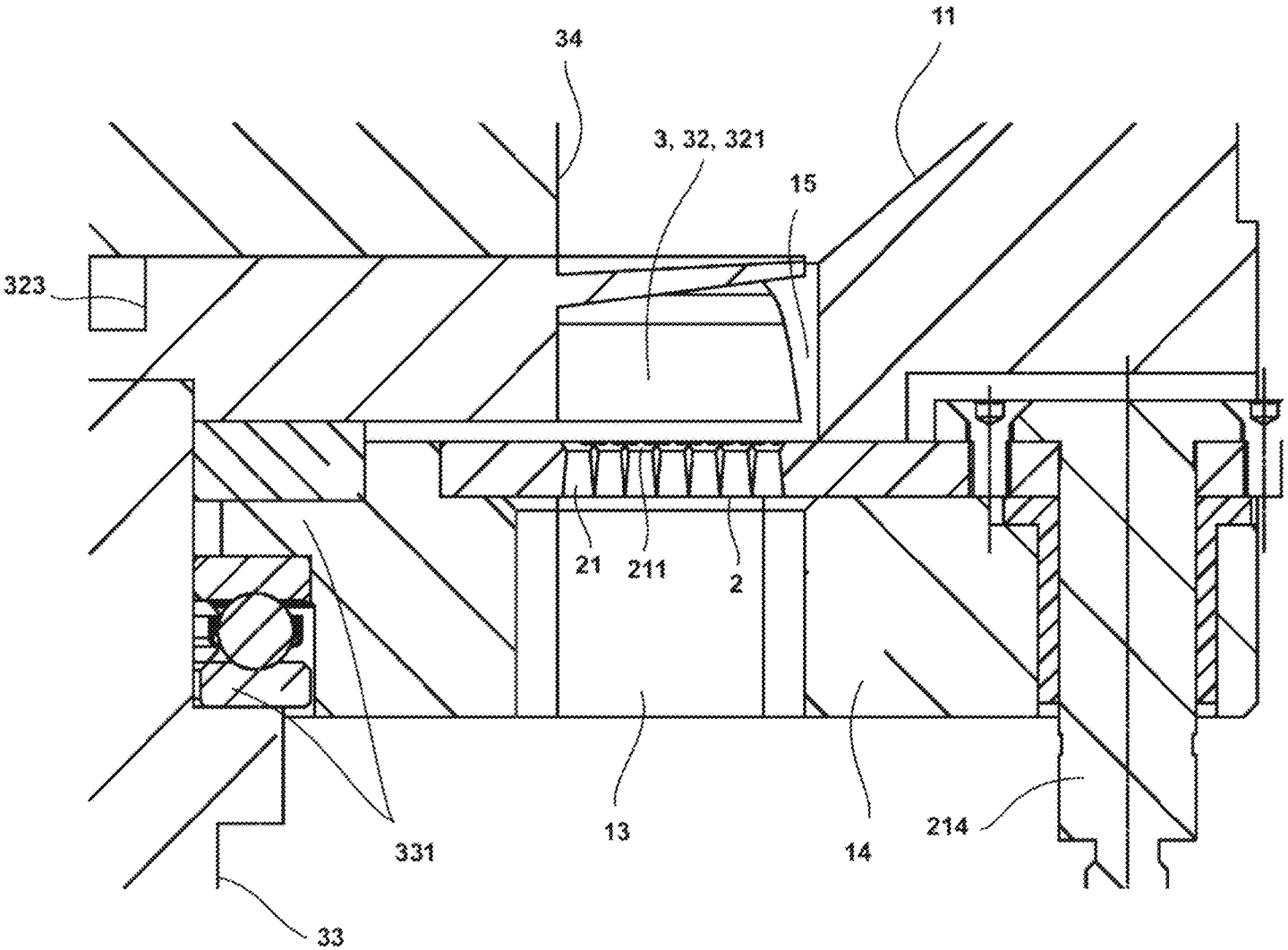
FIG. 6 shows a detail of a part of the device of FIG. 5 with the die.

The orifice 21 of the die 2, a detail of which is shown in FIG. 6 is on the side of the supply of granulate, that is on the side of the pushing-through member 3, provided by a recess 211 or other shape modification of the edge of the orifice 21 on the side of the supply of granulate, that is in direction into the die 2. Such shape modification provides the articulation and roughness of the die 2 necessary for efficient operation of the device. From the recess 211, the orifice 21 then continues either with the same diameter, or preferably widens, in this example it widens conically outwards from the die 2. Widening of the size of the orifice 21 outwards from the die 2 facilitates passing of the reduced granulate through the die 2. FIG. 6 relates to the second example of embodiment, which will be described further on, however, in this example it is used only for a detailed illustration of the embodiment of the orifice 21 itself, which, in this case, is for both examples identical.

Above the die 2, the pushing-through member 3 of the granulate is movably mounted, designed to push the granulate through into the orifices 21 of the die 2. The pushing-through member 3 is in this example of embodiment formed as a linear reciprocating tool 31, in this example cylindrical in shape corresponding to the cylindrical surface of the die 2, having a shank 311 and a working part 312. The shank 311 is placed in a bearing 4 in the body 1 and is connected to a source of linear reciprocating motion (not shown), which can preferably be the pneumatic system of a dry ice cleaning device. In this example, the working part 312 comprises two adjacent pushing-through surfaces 313 facing the die 2, each of which forms an acute angle with the surface of the die 2. The surfaces 313 of the working part 312 correspond with the cylindrical shape of the surface of the die 2, and thus in this case form a pair of truncated cones connected by their narrower parts, while forming a tapering 314 of the working part 312 allowing granulate from the dry ice container to fill the space between the surfaces 313 of the working part 312 and the surface of the die 2. The working part 312 is at the end preferably provided with an inclined surface 315 which forms substantially a wedge from this end of the working part 312. The cylindrical surface of the working part 312 is planed on one side, on the side of the supply of granulate from the container, that is, the body of the working part 312 of the pushing-through member 3 is planed on its portion remote from the die 2, in the example shown on its upper portion, to ensure better inlet to the space. Between the surface 313 and the surface of the die 2.

The distance of the pushing-through member 3 from the die 2, that is in this example of the utmost circumferential surfaces of the working part 312 and the adjacent surface of the die 2, is smaller than the largest dimension of the supplied granulate of dry ice. Also, the largest transverse size of the orifices 21, in this example the largest diameter of the orifices 21 is smaller than the largest dimension of the supplied granulate.

Below the die 2, in this example of embodiment, a collector 5 of reduced granulate is preferably connected to the body 1. The collector 5, in this example of embodiment as shown in the figures, comprises a collecting chamber 51, from which the granulate is then led through a collecting channel 52 towards the device for mixing of dry ice particles with the flow gaseous medium of a dry ice cleaning device.

The device according to the example of embodiment described above is working as follows.

The granulate from the supply of dry ice granulate, i.e. normally from the dry ice container, is moving gravitationally and due to the sloped surface 11 towards the die 2. Above the die 2, the pushing-through member 3 is moving in linear reciprocating motion, that is the linear reciprocating tool 31. The granulate, via the tapering 314 in the working part 312 of the tool 31, formed by a pair of truncated conical surfaces 313, is entering the space between the surfaces 313 and the surfaces of the die 2, which has a substantially wedge shape. When the tool 31 is passing in one direction, the granulate is moved and pushed against the die 2 by the action of one surface 313. Due to the recesses 211 on the orifices 21 of the die 2, or the shape modification of the edges of the orifices 21, the surface of the die 2 is sufficiently rough, and has roughness higher than that of the surfaces 313, in order for the granulate to be caught by the surface of the die 2, and to be pushed into the orifices 21 by the motion of the tool 31, while the granulate is being crumbled, that is, its size is reduced and the reduced granulate drops out from under the die 2. When the tool 31 is moving in the second, reciprocating, direction, the granulate is analogously moved and pushed against the die 2 by the action of the second surface 313. This ensures the working cycle of the device in both directions of reciprocating motion of the tool 31. Of course, it is possible to consider one single surface 313 on the tool 31, but this would obviously reduce the efficiency of the device as the working motion would be only in one direction of movement of the tool 31.

The orifices 21 of the die 2 present by their size a limitation for the size of the passing granulate. In order for the device to function properly, it is necessary that the die 2 in its embodiment would present significantly articulated and roughened surface compared to the working surfaces of the pushing-through member 3, in this example the surfaces 313 of the working part 312 of the tool 31. The geometry of the orifices 21 of the die 2 and the acting forces prevent formation of the granulate back to pellets. Processed granulate is characterized by brittleness and if a force is applied to it, it breaks into smaller particles. The product of the pushing-through are then particles of different size and shape, which, however, meet the size limitations defined by the die 2.

In addition, when the working part 312 of the tool 31 is provided at the end with the inclined surface 315 which forms substantially a wedge from the end of the working part 312, this arrangement prevents jamming of the granulate in front of the tool 31. The jamming of the granulate is undesirable for proper function of the device. Also, in this case it is not excluded that the working part 312 of the tool 31 would be terminated, for example, only by a flat face. This arrangement would also fulfill the similar function, but at the cost of increased resistance when the tool 31 would be passing through the granulate, or also undesirable crushing of the granulate in front of the tool 31. However, more likely a shortening of the working stroke of the pushing-through member 3 could also occur due to formation of an obstacle by jamming of the granulate.

When the collector 5 of reduced granulate is connected, the collecting chamber 51 serves as a reservoir for the crumbled granulate during drawing the granulate out. In the case the processed granulate is not drawn out, the chamber 51 is filled up to the orifices 21 in the die 2 and the granulate at the outlet of the orifices 21 prevents further crumbling of the granulate.

Output of the device is the reduced granulate which is practically an inhomogeneous mixture of dry ice particles of different sizes, however, with a size smaller than the granulate supplied to the device. For example, with standard granulate size of 3 to 3.5 mm and a diameter of the orifices 21 of the die 2 with a value of 2.5 mm, the output granulate has particles with a maximum size of up to 1.5 mm. As mentioned above, such size of the particles is suitable for less powerful dry ice cleaning devices, when the best efficiency of cleaning is ensured. Therefore, it is not necessary to purchase from the supplier a special granulate of non-standard size at a higher price, which would then increase the operating costs of the dry ice cleaning device, but it is sufficient to use with a given device the standard granulate with the best price, and the device according to the invention will allow trouble-free efficient operation and with the standard granulate that as such, would not provide desired cleaning efficiency.

Figure 4:
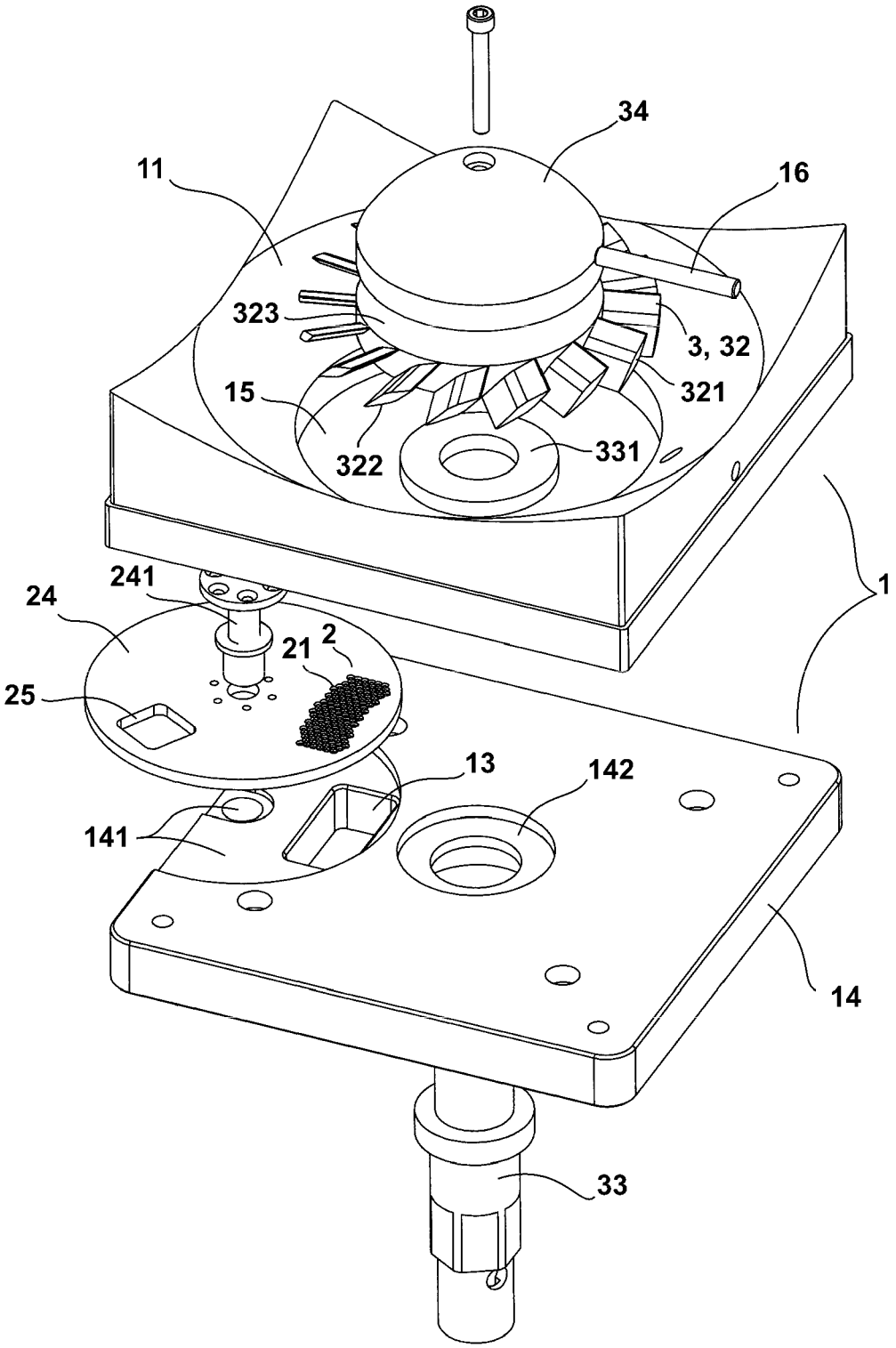
FIG. 4 shows an exploded view in perspective of the device according to the invention and its parts with the rotary granulate pushing-through member.
Figure 5:
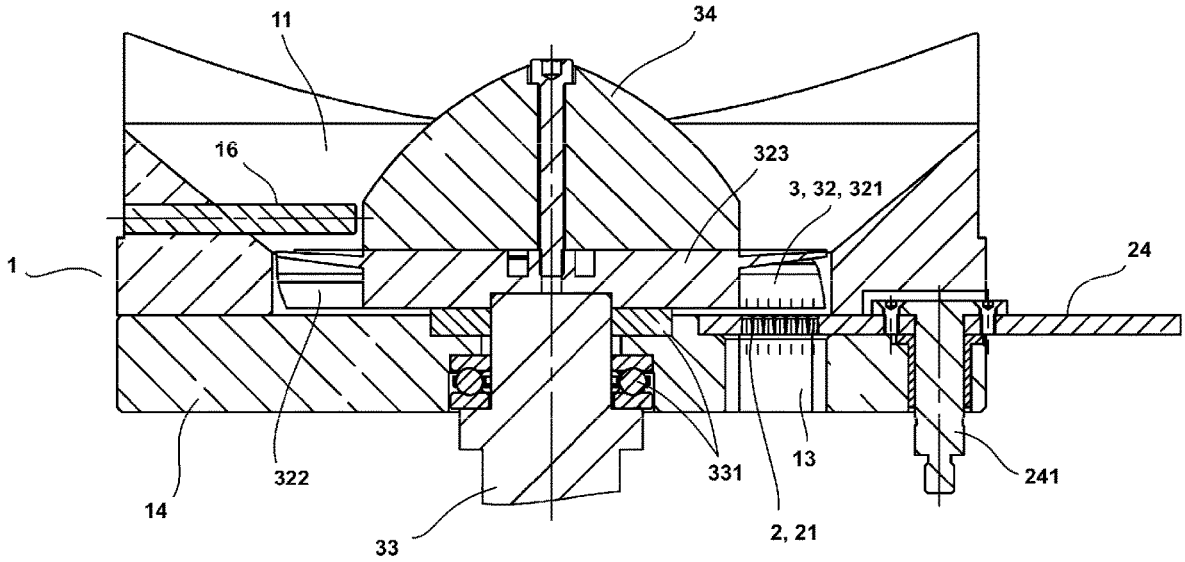
FIG. 5 shows a sectional side view of the device according to the invention with the rotary granulate pushing-through member.

The device according to this invention according to the second example of embodiment, with rotational motion of the pushing-through member 3, is shown in FIGS. 4, 5 and 6. The device comprises the body 1 with sloped surface 11 inclining to the inside of the body 1, in particular, in the form of conical surface. In general, the body 1 is designed to be connectable to the supply of dry ice granulate in a dry ice cleaning device. In this example of embodiment, the body 1 is connectable to a dry ice container, where it will form the bottom of the dry ice container. This body 1 can also be formed as an integral part of the dry ice container. Thus, in this example, the supply of granulate will be provided by a conventional dry ice container, from which the granulate is gravitationally, or optionally with an aid of an air auxiliary drawn through the container, fed to a device for mixing of dry ice particles with the flow of air.

In the body 1, below the sloped surface 11, the die 2 with a set of orifices 21 is placed. The die 2 is formed in this example as flat. The die 2 is according to this example of embodiment preferably provided on a turntable 24. The turntable 24 is pivotally mounted in a compartment 141 in the base plate 14 of the body 1 by means of a pivot 241, in front of the outlet opening 13 of the reduced granulate located in the base plate 14 of the body 1. A portion of the turntable 24 protrudes outside the body 1. The turntable 24 also preferably comprises a die inactivator 25 in the form of an aperture on the turntable 24, which lies on the same circle as the die 2. The die inactivator 25 then ensures free passage of a granulate from the container. Of course, it is possible for the die 2 to be arranged on the base plate 14 also fixedly, that is as a part of the base plate 14. Then, in such embodiment, the turntable 24 is not present. The turntable 24 can also comprise several dies 2 with different size of the orifices 21, and by turning the turntable 24 it is then possible to simply change the dies 2 according to desired size of the reduced granulate.

Analogously as in the first example of embodiment, the orifice 21 of the die 2, a detail of which is shown in FIG. 6 is on the side of the supply of granulate, provided by the recess 211 or other shape modification of the edge of the orifice 21 on the side of the supply of granulate, that is on the side of the pushing-through member 3. Such shape modification provides the articulation and roughness of the die 2 necessary for efficient operation of the device. From the recess 211, the orifice 21 then continues either with the same diameter or size, or preferably widens, in this example it widens conically outwards from the die 2. Widening of the size of the orifice 21 outwards from the die 2 facilitates passing of the reduced granulate through the die 2. FIG. 6 relates to the second example of embodiment, which will be described further on, however, in this example it is used only for a detailed illustration of the embodiment of the orifice 21 itself, which, in this case, is for both examples identical.

Above the die 2, the pushing-through member 3 is movably mounted, to push the granulate through into the orifices 21 of the die 2. The pushing-through member 3 is in this example of embodiment formed as a rotary blade wheel 32. The rotary blade wheel 32 is mounted on a drive shaft 33. The drive shaft extends through the base plate 14 of the body 1, where it is placed in bearings 331 in a housing 142 of the drive shaft 33 in the base plate 14. The drive shaft can be driven by the drive of the device for mixing of dry ice particles with the flow of gaseous medium in a dry ice cleaning device, in which the device according to the invention is located. Of course, it is not excluded that the shaft 33 is connected to a separate drive, independent of the drive of the mixing device.

The blade wheel 32 comprises an array of blades 321. The blade 321 comprises a surface 322 facing the die 2. The surface 322 forms an acute angle with the surface of the die 2. In the embodiment according to the illustrated example of embodiment, the blades 321 are formed as flat blades facing the die 2 at an acute angle in the direction of rotation of the blade wheel 32. The blades 321 are evenly spaced on the wheel 32 at positions forming gaps between the blades 321 serving for inlet of the granulate. A space in which the blades 321 move forms a working circular ring 15 of the body 1. The die 2 is then situated in this circular ring 15.

The orifices 21 of the die 2 present by their size a limitation for the size of the passing granulate. In order for the device to function properly, it is necessary that the die 2 in its embodiment would present significantly articulated and roughened surface compared to the working surfaces of the pushing-through member 3, in this example the surfaces 322 of the blades 321 of the blade wheel 32. The geometry of the orifices 21 of the die 2 and the acting forces prevent formation of the granulate back to pellets. Processed granulate is characterized by brittleness and if a force is applied to it, it breaks into smaller particles. The product of the pushing-through are then particles of different size and shape, which however, meet the size limitations defined by the die 2.

Preferably, the blade wheel 32 is on the side of the supplied granulate provided with a guiding member 34 of the granulate. In this example of embodiment, the guiding member 34 of dome shape is connected to the body 323 of the blade wheel 32. This creates sloped rotary surface practically fulfilling the same function as the surface 11, that is, it directs the granulate to the working circular ring 15, that is, to the die 2.

The distance of the pushing-through member 3 from the die 2, that is in this example of the edge of the blade 321 and the adjacent surface of the die 2, is smaller than the largest dimension of the supplied granulate of dry ice. Also, the largest transverse size of the orifices 21, in this example the largest diameter of the orifices 21 is smaller than the largest dimension of the supplied granulate.

Preferably, a static pin 16 is arranged in the body 1, which in this example of embodiment protrudes from the body 1 into the space above the blades 321, above which it is at a certain distance. The distance of the pin 16 from the highest point of the blade 321 should be less than the mutual distance of the blades 321, that is the spacing of the blades 321. This ensures that possible aggregates of the granulate do not exceed the size of feeding gaps, that is the gaps between the blades 321, and can freely enter the working space. The function of this pin 16 is to prevent agglomeration of the granulate during operation of the device as will be described further.

The device according to the example of embodiment described above is working as follows.

The granulate from the supply of dry ice granulate, i.e. normally from the dry ice container, is moving gravitationally, or optionally with an aid of drawn-in air, due to the sloped surface 11 and the sloped surface of guiding member 34, in direction towards the working circular ring 15, that is towards the die 2. The granulate is passing through the gaps between the blades 321 into the space defined by the surface 322 of the blade 312 facing the die 2 and the surface of the die 2, which has substantially a wedge shape. With rotation of the rotary blade wheel 32 by the action of the surface 322 of the blade 321, the granulate is moved and pushed against the die 2. Due to the recesses 211 on the orifices 21 of the die 2, or the shape modification of the edges of the orifices 21, the roughness of the die 2 is higher than the roughness of the working surfaces of the blades 321. The surface of the die 2 is thus sufficiently rough for the granulate to be caught by the surface of the die 2, and to be pushed into the orifices 21 by the motion of the wheel 32, while the granulate is being crumbled, that is, its size is reduced and the reduced granulate drops out from under the die 2. This granulate drops out through the outlet opening 13 of the reduced granulate in the base plate 14, which is situated below the die 2, and is led to the device for mixing of dry ice particles with the flow of air a dry ice cleaning device.

When the static pin 16 is located in the body 1, possible agglomerates of the granules are carried by the blades 312 against this static pin 16, which ensures their disintegration, thus preventing possible blockage of the space between the blades 312 and ensuring continuity in filling of the space between the surface 322 of the blade 312 and the surface of the die 2. The secondary function of the blade wheel 32 is thus to prevent agglomeration of the granulate by its motion. The granulate at the bottom of the container is thus in constant motion and the spent granulate is continuously gravitationally refilled with new granulate, and in the case of lump formation, i.e. agglomerates of the granules, by the movement of the blades 312 against the static pin 16, these are trapped and crushed between the pin 16 and the blades 312.

When the die 2 is placed on the turntable 24 as described above, and the inactivator 25 of the die 2, and/or other dies 2 with different sizes of the orifices 21, are also located on this turntable 24, by simply turning the turntable 24 it is possible to easily change the die 2 for another one with a different size of the orifices 21, also, it is possible to reduce the number of active orifices 21 of the die 2, or to completely deactivate the die 2, that is to "turn off" the device for reducing the size of the granulate. This can be realized by turning the turntable 24. When substantially all of the orifices 21 of the die 2 are above the outlet opening 13 of the reduced granulate in the base plate 14, the device operates in the maximum mode of production of reduced granulate and the flow of granulate. When, by turning the turntable 24 only a part of the orifices 21 of the die 2 is above the outlet opening 13, and a part of the orifices 21 is covered by the base plate 14, the device is in a mode of reduced production of the amount of reduced granulate and reduced flow of granulate. When, by turning the turntable 24 the die inactivator 25 is moved over the outlet opening 13, which is practically only an hole in the turntable 24, the outlet opening 13 is practically directly connected to the supply of dry ice granulate, i.e. to the content of dry ice granulate container, and thus raw granulate is fed to the opening 13 by the blades 312, that is the one which is originally fed or filled into a dry ice container, without any change of its size.

Output of the device is the reduced granulate which is practically an inhomogeneous mixture of dry ice particles of different sizes, however, with a size smaller than the granulate supplied to the device. For example, with standard granulate size of 3 to 3.5 mm and a diameter of the orifices 21 of the die 2 with a value of 2.5 mm, the output granulate has particles with a maximum size of up to 1.5 mm. As mentioned above, such size of the particles is suitable for less powerful dry ice cleaning devices, when the best efficiency of cleaning is ensured. Therefore, it is not necessary to purchase from the supplier a special granulate of non-standard size at a higher price, which would then increase the operating costs of the dry ice cleaning device, but it is sufficient to use with a given device the standard granulate with the best price, and the device according to the invention will allow trouble-free efficient operation and with the standard granulate that as such, would not provide desired cleaning efficiency.

The above described examples of embodiments shown in the drawings represent particular construction embodiments of the device according to the invention, and are given as an illustrative example, whereas it is obvious that other design variants are possible within the scope of the idea of this invention. These other embodiments may relate, for example, to the shape and number of sloped surfaces 11, the shape and number of surfaces 313, 322 facing the surface of the die 2, the shape and number of orifices 21 in the die 2, the shape of modification of the edge, or the recess 211 of the orifice 21, the shape of the guiding member 34, bearings of moving elements of the device and the like. Also, said device according to the invention is not limited to the specifically mentioned granulate size of 3 to 3.5 mm, but it is obvious that the device can be used for reducing the granulate of any other size, by respective adjusting the distance between the pushing through member 3 and the die 2 and respective adjusting the size of the orifices 21 of the die 2 in relation to the size of the inlet granulate and required maximum size of the reduced outlet granulate.

The supply of the granulate in the above described examples of embodiments is provided by a dry ice granulate container, for the most common and the most preferred gravitational supply of dry ice granulate. However, it is not excluded that the supply may also be provided in other form, for example by a supply pipe with a forced movement of the granulate into the device.

INDUSTRIAL APPLICABILITY

The device according to the invention can be smoothly used in known types of dry ice cleaning devices, as part of two-hose system, where for example an arrangement with the linear reciprocating pushing-through element 3 is usable, and also as part of one-hose system, where for example an arrangement with the rotary pushing-through member 3 is usable.

The invention claimed is:

1. A device for reducing the size of dry ice granules for dry ice cleaning devices comprising a supply of dry ice to a device for mixing of dry ice particles with the flow of gaseous medium, where the device for reducing the size of dry ice granules comprises a die with a set of orifices for granules passing and granules pushing-through member for pushing the granules into this die, wherein the die is placed in a body with at least one sloped surface inclining to the inside of the body towards the die, the body, is connectable to a supply of dry ice granules for a device for mixing of dry ice particles with the flow of gaseous medium in a dry ice cleaning device, the granules pushing-through member is movably mounted above the die for pushing the granules into the die, where the pushing-through member comprises at least one surface facing the die, where this surface forms an acute angle with the die surface, the orifices of the die at the side of the pushing-through member are provided with a recess increasing the roughness of the surface of the die relative to the roughness of the surface of the pushing-through member for the granules to be caught by the surface of the die and to be pushed into the orifices by the motion of the pushing-through member while the granules are being crumbled and reduced in its size the pushing-through member is located above the surface of the die at a distance smaller than the dimensions of the supplied dry ice granules, and the largest transversal dimension of the orifices of the die is smaller than the largest dimension of the supplied granules, where below the die is an outlet opening for the reduced granules to a device for mixing of dry ice particles with the flow of gaseous medium, wherein the pushing-trough member is linear reciprocating tool comprising a working part provided with at least one surface facing the die and forming an acute angle with the surface of the die.

2. The device according to claim 1, wherein each orifice widens outwardly from the recess.

3. The device according to claim 1, wherein the working part is at its end provided by a sloped surface.

4. The device according to claim 1, wherein a collector of the reduced granules with a collecting chamber for collecting the reduced granules is connected to the outlet opening.

5. The device according to claim 1, wherein the supply of dry ice granules to the device for mixing of dry ice particles with the flow of gaseous medium in the dry ice cleaning device is a dry ice container for dry ice cleaning devices and the body forms the bottom of the dry ice container.

6. A device for reducing the size of dry ice granules for dry ice cleaning devices comprising a supply of dry ice to a device for mixing of dry ice particles with the flow of gaseous medium, where the device for reducing the size of dry ice granules comprises a die with a set of orifices for granules passing and granules pushing-through member for pushing the granules into this die, wherein the die is placed in a body with at least one sloped surface inclining to the inside of the body towards the die, the body, is connectable to a supply of dry ice granules for a device for mixing of dry ice particles with the flow of gaseous medium in a dry ice cleaning device, the granules pushing-through member is movably mounted above the die for pushing the granules into the die, where the pushing-through member comprises at least one surface facing the die, where this surface forms an acute angle with the die surface, the orifices of the die at the side of the pushing-through member are provided with a recess increasing the roughness of the surface of the die relative to the roughness of the surface of the pushing-through member for the granules to be caught by the surface of the die and to be pushed into the orifices by the motion of the pushing-through member while the granules are being crumbled and reduced in its size the pushing-through member is located above the surface of the die at a distance smaller than the dimensions of the supplied dry ice granules, and the largest transversal dimension of the orifices of the die is smaller than the largest dimension of the supplied granules, where below the die is an outlet opening for the reduced granules to a device for mixing of dry ice particles with the flow of gaseous medium, wherein the pushing-through member is a rotary blade wheel rotatively mounted in a body base plate, the blade wheel comprises an array of blades, where a blade of the blade wheel comprises a surface facing the die and forming an acute angle with the surface of the die, the blades are evenly spaced on the wheel at positions forming gaps between the blades serving for inlet of the granules, where the die is situated in a working circular ring of the body formed by a space in which the blades move.

7. The device according to the claim 6, wherein the blade wheel has a body provided with a guiding member of the supplied granules.

8. The device according to the claim 7, wherein the die is arranged on a turntable pivotally mounted in the base plate of the body, where the turntable further comprises an inactivator of the die in the form of an aperture lying on the same circle as the die, and/or at least one other die with a different size of orifices.

9. The device according to the claim 6, wherein a static pin is arranged in the body, which protrudes from the body into the space above the blades, where the distance of the pin from the highest point of the blade is less than blade spacing on the blade wheel.

10. The device according to the claim 6, wherein each orifice widens outwardly from the recess.

11. The device according to claim 6, wherein the supply of dry ice granules to the device for mixing of dry ice particles with the flow of gaseous medium in the dry ice cleaning device is a dry ice container for dry ice cleaning devices and the body forms the bottom of the dry ice container.

* * * * *